US010883725B2

(12) United States Patent
Ha

(10) Patent No.: US 10,883,725 B2
(45) Date of Patent: Jan. 5, 2021

(54) VENT AND COOKER HAVING A VENT

(71) Applicant: LG ELECTRONICS INC., Seoul (KR)

(72) Inventor: Yeonsik Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 360 days.

(21) Appl. No.: 15/596,246

(22) Filed: May 16, 2017

(65) Prior Publication Data

US 2018/0058701 A1 Mar. 1, 2018

(30) Foreign Application Priority Data

Aug. 26, 2016 (KR) ..... 10-2016-0109174

(51) Int. Cl.
*F24C 11/00* (2006.01)
*H05B 6/12* (2006.01)
(Continued)

(52) U.S. Cl.
CPC ..... *F24C 11/00* (2013.01); *F24C 3/06* (2013.01); *F24C 15/101* (2013.01);
(Continued)

(58) Field of Classification Search
CPC ..... F24C 11/00; F24C 3/06; H05B 6/1209; H05B 6/1263; H05B 2206/022
(Continued)

(56) References Cited

U.S. PATENT DOCUMENTS 4,899,028 A * 2/1990 Arai ..... F24C 15/101 126/21 A
5,446,268 A * 8/1995 Chen ..... F24C 15/101 126/21 A
(Continued)

FOREIGN PATENT DOCUMENTS

CN 1777778 5/2006
CN 200975721 11/2007
(Continued)

OTHER PUBLICATIONS

Chinese Office Action (with English translation) dated Jan. 11, 2019 issued in CN Application No. 201710083186.5.
(Continued)

*Primary Examiner* — Steven B McAllister
*Assistant Examiner* — Allen R Schult
(74) *Attorney, Agent, or Firm* — Ked & Associates LLP

(57) ABSTRACT

A vent and a cooker having a vent are provided for which a built-in component accommodated in the cooker is not easily visible from the outside through an exhaust hole provided in the vent, which enables simple manufacturing and assembly, which can smoothly discharge exhaust gas, and has a function as a support structure of the cooker, and a vent structure thereof. The vent may include a main vent configured to be exposed through an upper portion of the cooker and including a main exhaust surface having main exhaust holes and a sub-vent spaced apart from a lower portion of the main vent and aligned in parallel with the main exhaust surface and including a sub-exhaust surface having sub-exhaust holes.

12 Claims, 7 Drawing Sheets

(51) Int. Cl.
*F24C 15/10* (2006.01)
*F24C 3/06* (2006.01)

(52) U.S. Cl.
CPC ..... *H05B 6/1209* (2013.01); *H05B 6/1263* (2013.01); *H05B 2206/022* (2013.01)

(58) Field of Classification Search
USPC ..... 126/39 K
See application file for complete search history.

(56) References Cited

U.S. PATENT DOCUMENTS

| | | | | |
|---|---|---|---|---|
| 6,021,774 | A * | 2/2000 | Taplan | F24C 1/04 126/211 |
| 2006/0144388 | A1 | 7/2006 | Hosoi et al. | |
| 2010/0101554 | A1 | 4/2010 | Yi | |
| 2011/0186035 | A1 | 8/2011 | Kwon et al. | |
| 2015/0184863 | A1* | 7/2015 | Kim | F24C 3/008 126/39 E |
| 2015/0323195 | A1 | 11/2015 | Chadwick et al. | |

FOREIGN PATENT DOCUMENTS

| | | |
|---|---|---|
| CN | 203549938 | 4/2014 |
| EP | 0 433 209 | 6/1991 |
| EP | 1 726 885 | 11/2006 |
| JP | 10-110958 | 4/1998 |
| JP | 2006-322645 | 11/2006 |
| JP | 2008-269797 | 11/2008 |
| JP | 2013-020979 | 1/2013 |
| KR | 10-2008-0069449 | 7/2008 |
| WO | WO 2010/013888 | 2/2010 |

OTHER PUBLICATIONS

Korean Office Action dated Jul. 14, 2017 issued in Application No. 10-2016-0109174.

European Search Report dated Jul. 24, 2017 issued in Application No. EP 17 17 3034.4.

* cited by examiner

VENT AND COOKER HAVING A VENT

CROSS-REFERENCE TO RELATED APPLICATION(S)

This application claims the priority of Korean Patent Application No. 10-2016-0109174, filed in Korea on Aug. 26, 2016, in the Korean Intellectual Property Office, the disclosure of which is hereby incorporated by reference in its entirety.

BACKGROUND

1. Field

A vent and a cooker having a vent and disclosed herein.

2. Background

In general, a cooker may cook food or other items by heat generated using gas or electricity. A typical cooker using electricity may be an induction heating cooker. Generally, an induction heating cooker may perform a cooking function in such a manner that a high-frequency current flows through a working coil or a heating coil, and thus strong magnetic force lines are generated when the high-frequency current flows through the working coil or the heating coil. When the strong magnetic force lines pass through a cooking container, eddy current flows and the cooking container itself may be heated.

The basic heating principle of the induction heating cooker will be described as follows. When a current is applied to the heating coil, a cooking container which is made of a magnetic substance may be heated by self-induction heating, so that food contained in the cooking container is cooked. Therefore, the induction heating cooker may not generate combustion exhaust gas because it does not need to burn gas, and the heat may be instantly generated in the container itself, thereby minimizing a heat transfer process through heat radiation or conduction. Accordingly, there are advantages in that food can be heated quickly.

However, such an induction heating cooker is problematic in that thermal power may be limited as there is a problem of increase in fuel cost due to a large amount of electric power consumed when a plurality of heating coils is driven at the same time, and a problem of heat generation of a circuit controlling a heating coil. A typical cooker using gas may be a gas range. In general, a gas range may be an open flame type in which a burner is exposed to an outside of a product and a flame directly heats food or a container containing food, or a radiant type in which a burner is provided inside of the product, and which heats a radiator using heat of combustion and heats the food or the container containing the food using radiation waves radiated from the heated radiator to the outside.

Korean Patent Application Publication No. 10-2008-0069449, which is incorporated by reference, discloses a heating cooker with a structure in which an upper surface of a case is shielded by a ceramic plate, a burner system which is ignited by a supply of gas is provided in a space inside of the case below the ceramic plate, and a gas valve is opened and closed through manipulation of a manipulation switch to thereby regulate thermal power.

The technology using gas, such as the radiant type, uses heat generated by a combustion reaction of a fuel, for cooking, so that thermal energy may be used very efficiently, and a fuel cost may be reduced using a gas which is lower in cost than electricity. However, the gas heating method has a disadvantage in that a heat transfer path of the gas heating cooker is longer than a heat transfer path of the induction heating cooker, and thus, food cannot be heated quickly when compared with the induction heating cooker. In addition, as the gas heating method burns a fuel, such as a gas, there arises a troublesome problem that combustion exhaust gas necessarily occurs.

The induction heating cooker and the fuel combustion heating cooker may provide users with a variety of conveniences if they can be used together in a way that the merits of one approach complement the disadvantages of the other. However, when trying to make a cooker having a combination of two cookers having different heating methods and different cooling methods, various problems which have not been experienced before are encountered.

For example, if an induction heating system and a radiant type fuel combustion system are applied in one case, combustion may occur in the case. The amount of heat generated when a fossil fuel is burned is much higher than heat generated in an induction heating system. In addition, a temperature of the former is also quite a bit higher than a temperature of the latter. Therefore, it may be necessary to change the cooling methods for them and to prevent hot air or exhaust gas from mixing together when discharging the hot air or the exhaust gas. In particular, as a chip (called an Insulated Gate Bipolar Transistor (IGBT)) which drives a working coil of an induction heating structure is very sensitive to heat, it is necessary to prevent heat energy generated from a fuel combustion device from moving toward an induction heating device.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. It is to be understood that the embodiments are not limited to the disclosed embodiments, but may be embodied in many different forms and should not be construed as limited to the embodiments set forth herein. Rather, these embodiments are provided so that this disclosure will be thorough and complete.

Figure 1:
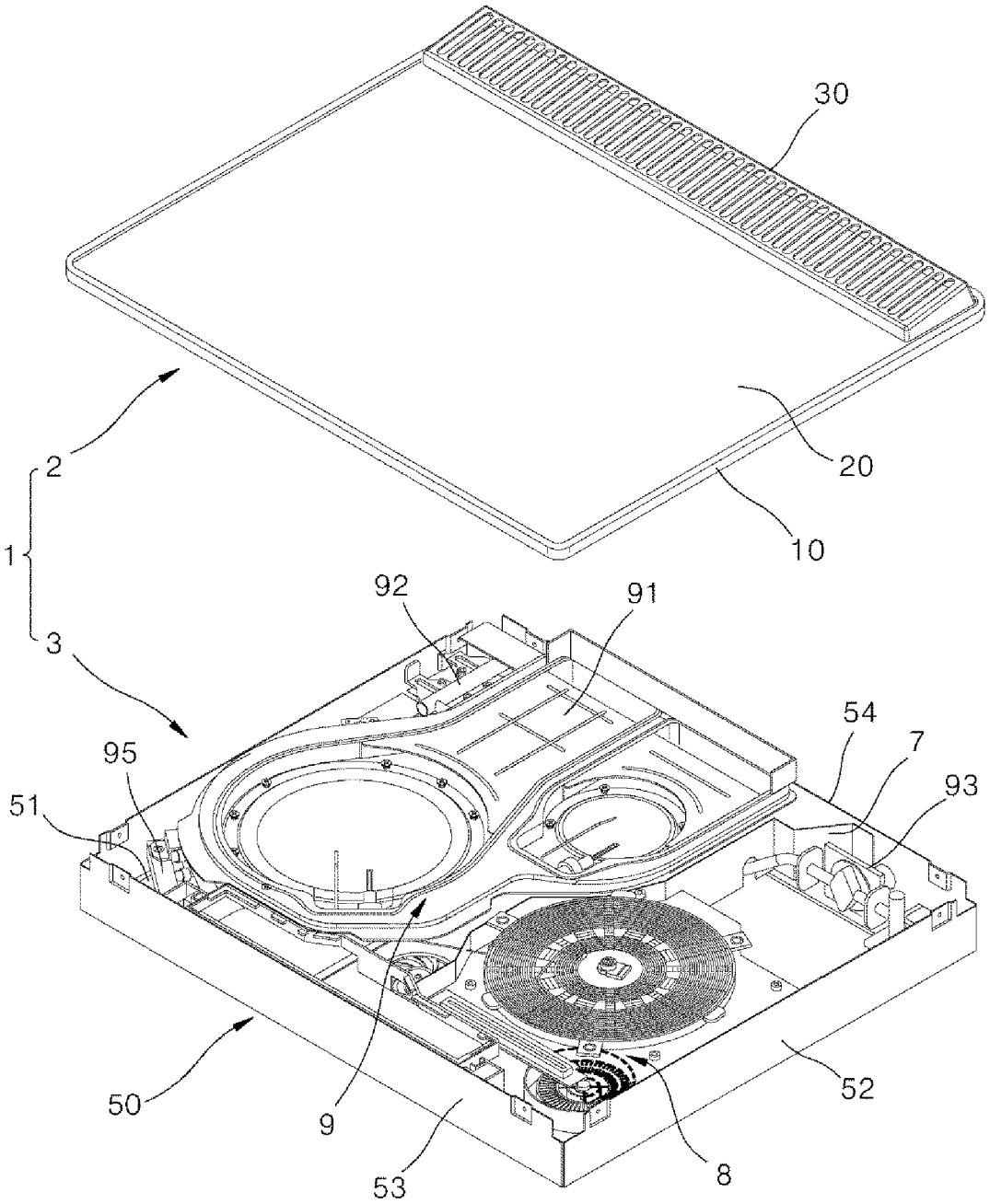
FIG. 1 is a perspective view showing a state in which a case and a top plate portion of a cooker according to an embodiment are separated.

A cooker 1 may be divided into a top plate 2 and a main body 3, as shown in FIG. 1. The main body 3 may accommodate a plurality of components for operating the cooker 1 in a case 50, which may be made of a plate-shaped steel material. Two side portions or sides 52, a front portion or front 53, and a back portion or back 54 of the case 50 may be upwardly bent at four corner edges of a rectangular bottom portion or bottom 51 forming a bottom plate of the case 50, and an upper portion of the case 50 may be open.

The open upper portion of the case 50 may be covered with and fixed to the top plate 2. A width of the top plate 2 may be larger than a width of the bottom 51. The cooker 1 may be mounted on a counter top, and may be placed in an opening which is wider than the bottom 51 and smaller than the top plate 2. That is, a bottom of the top plate 2, which projects outwardly laterally more than the bottom 51, may be installed in a kitchen by being placed in an open edge of a counter top.

The top plate 2 may shield the opening in the counter top when the cooker 1 is mounted on the counter top, and may be exposed on the counter top to form an upper appearance of the cooker 1. In addition, the top plate 2 may include a plate 20 that provides a surface on which a container for cooking and food may be placed. In addition, a vent member or vent 30 may be provided at a rear of the top plate 20 and serve as a passage through which air discharged after cooling internal components of the main body 3, or exhaust gas of a mixture of a fuel and air combusted in the main body 3 may be discharged.

Figure 2:
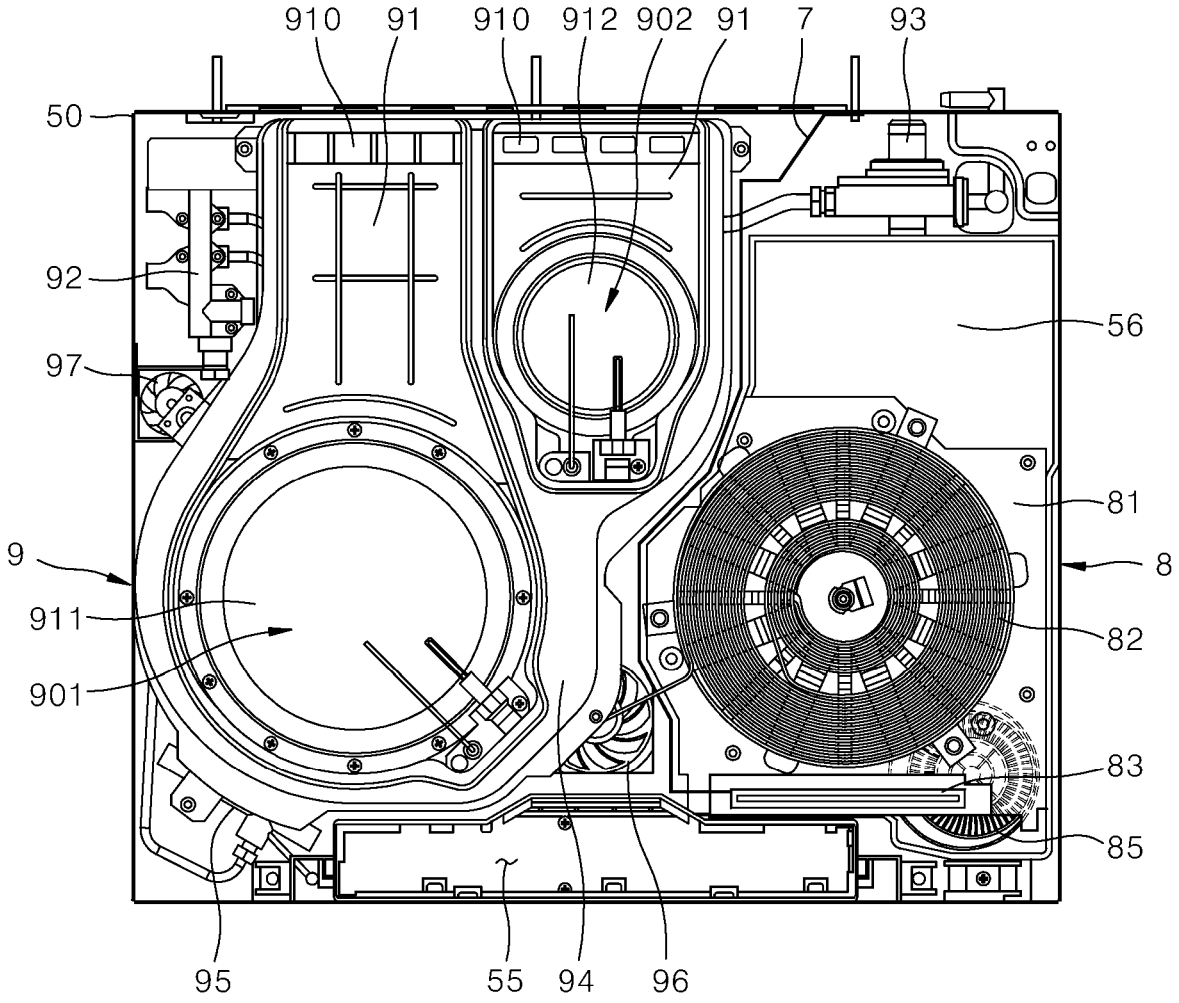
FIG. 2 is a plan view of the case of the cooker of FIG. 1.
Figure 3:
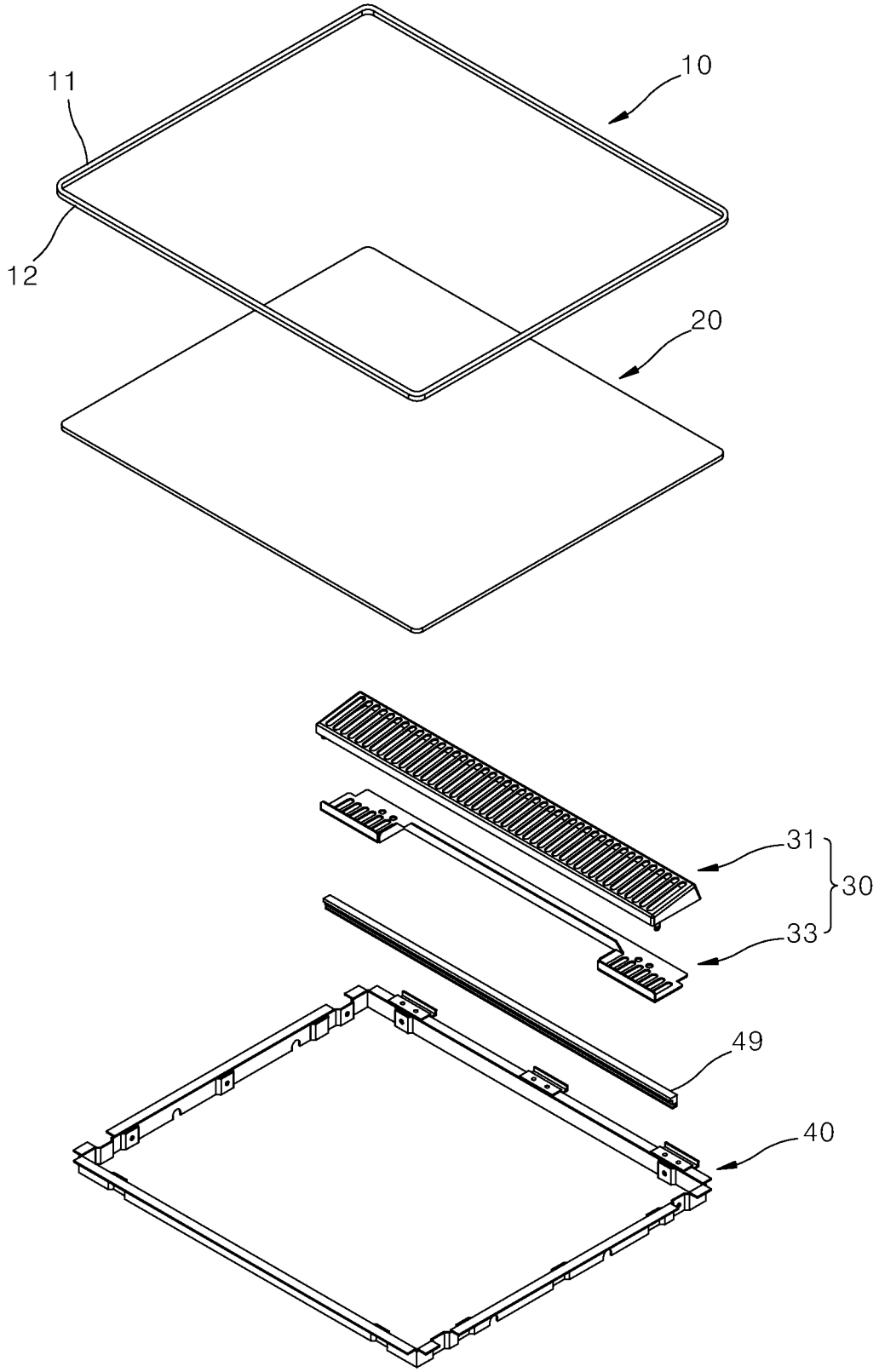
FIG. 3 is an exploded perspective view of a top plate of the cooker of FIG. 1.

Referring to FIGS. 1 and 2, the case 50 may function as a housing of the main body 3 of the cooker 1, and a gas combustion heating unit or heater 9, which is a first cooking heating unit or heater, and an induction heating unit or induction heater 8, which is a second cooking heating unit or heater, may be housed in the case 50. The first cooking heating unit and the second cooking heating unit may perform heating to cook in different ways. An inner space of the case 50 may be divided into a space for the gas combustion heating unit 9 and a space for the induction heating unit 8 by a barrier 7 serving as a partition. The barrier 7 may spatially isolate the two spaces.

In this embodiment, the gas combustion heating unit 9 located at a first side of the barrier 7 in a first space may include a plurality of burners 901 and 902 that burn a mixed gas supplied thereto, and an insulator 94 that fixes and receives the burners. The first burner 901 and the second burner 902 may be accommodated in and modularized with the insulator 94. The modularized insulator 94 may be accommodated in the first space of the case 50 separated by the barrier 7.

The first burner 901 may be located at a front first side of the cooker 1 and the second burner 902 may be located at a rear central portion of the cooker 1. However, a number and positions of the burners of the cooker according to embodiments are not limited thereto.

Gas may be supplied to the first burner 901 and the second burner 902. The gas may be supplied to the cooker 1 via a governor valve 93 provided at a first rear end of the case 50. When the governor valve 93 is closed, a supply of gas into the cooker 1 may be blocked.

When the governor valve 93 is opened, the gas which has passed through the governor valve 93 may move along a piping and flow into a valve assembly or distribution valve 92 provided at a second rear end of the case 50. The gas introduced into the valve assembly 92 may be branched and controlled to be independently supplied to each of the burners 901 and 902.

The gas supplied from the valve assembly 92 may flow into each of the burners 901 and 902 through a nozzle 95. When the gas is injected into each burner through the nozzle 95, primary air may be mixed by a negative pressure generated by movement of the gas under pressure and may be introduced into the burner. In addition, a mixture of air and gas introduced into a combustion chamber of the burner may be burned in the burner.

Thus, the first burner 901 and the second burner 902 may independently burn gas, and combustion heat of the gas may heat heat storage plates 911 and 912 of the burner. When the heat storage plates 911 and 912 are heated to a high temperature, they may radiate heat upwardly. The exhaust gas burned in the first burner 901 and the second burner 902 may flow along respective exhaust ducts 91 extending to a rear side of the insulator 94 and may be discharged to discharge ports 910 which may be opened at ends of the exhaust ducts 91.

As the exhaust ducts 91 define paths through which exhaust combustion gases are discharged, the exhaust ducts 91 may be continuously exposed to high-temperature combustion exhaust gas and may rise to a considerably high temperature. In order to prevent the heat generated by the combustion of the gas from excessively raising the temperature of other components other than the heat storage plates, air to cool the gas combustion heating unit 9 separated by the barrier 7 may be supplied in a space toward the gas combustion heating unit 9. Therefore, in this embodiment, a box fan-shaped first fan 96 may be installed on the bottom 51 of the case 50.

The first fan 96 may supply air with a relatively low temperature in a space below an outer side of the case 50 toward the gas combustion heater 9 in the case 50. A portion of the supplied air may be supplied to primary air to make a mixed gas at the nozzle as described above. Most of the remaining air may come into contact with the outer surface of the insulator 94 and the outer surface of the exhaust ducts 91 extending to the rear of the insulator 94 to cool the insulator 94 and the exhaust ducts 91, and may be discharged upwardly through the discharge ports 910 provided at the rear of the case 50. A portion of the remaining air in the air supplied through the first fan 96 may also contact a manipulation unit accommodated in a receiving part or portion 55. After cooling the manipulation unit, the air may be moved to the discharge ports 910 and may be discharged upwardly.

For example, the manipulation unit may be manipulated by a user to adjust thermal power of the cooker 1. The manipulation may be performed by a touch operation of the user. However, various other methods other than touch may be applied as the manipulation method.

The exhaust gas flowing through and discharged from the insulator 94 through the discharge ports 910 and the air discharged from the case 50 after cooling the gas combustion heating unit 9 to cool the space in the gas combustion heat unit 9 may be mixed and discharged upwardly. A second fan 97 that separately cools the valve assembly 92 may be provided at a second rear portion of the case. The second fan 97 may also be a box fan. The air introduced from a lower portion of an outer space of the case by the second fan 97 may be moved to the rear of the case and may be discharged to the outside through the vent 30. The valve assembly 92 may include a valve to control distribution and supply of the gas. An internal structure that controls the valve assembly 92 may be sensitive to heat.

In view of this, the separate second fan 97 to cool the valve assembly 92 may be provided, and the valve assembly 92 may be cooled separately from the insulator 94. Therefore, air may be discharged to the outside through the vent 30 without a separate duct structure at a rear portion of the case 50 at a position where the valve assembly 92 is provided.

In a second space defined by the barrier 7 in the case 50, the induction heating unit 8 may be provided as the second cooking heating unit that performs heating for cooking in a manner different from the first cooking heating unit. The induction heating unit 8 may include a working coil 82 provided on an intermediate plate 81 provided in front of the first space defined by the barrier 7 and a control PCB provided on the bottom 51 of the case 50 below the intermediate plate 81, and a noise filter PCB provided at the bottom portion 51 of a receiving portion or space 56 provided at a rear portion of the first space of the case.

The induction heating unit 8 may further include a display unit or display 83 installed on the intermediate plate 81 in front of the working coil 82 and capable of emitting visible light upward. The display unit 83 may visually display that the working coil is operating when the working coil 82 is operating.

The noise filter PCB may remove noise from a power source to be supplied to the working coil, and the control PCB may control the operation of the working coil. An IGBT, which is a type of high heat emitting chip, may be mounted on the control PCB. This chip needs to be temperature-controlled. When the temperature exceeds a predetermined temperature, the working coil may not be controlled.

In consideration of this point, a third fan 85 may be installed on a first front side of the case 50. The third fan 85 may be a sirocco fan that suctions air from a lower portion of the outer space of the case 50 and discharges the air to the rear side of the case 50.

The air introduced into the space on the first side of the barrier 7 via the sirocco fan may first come into contact with the IGBT chip and a heat sink attached to the IGBT chip to cool the IGBT chip. A portion of the air may cool the working coil 82 installed on the intermediate plate 81, and may also cool a portion of the noise filter PCB installed in the accommodating portion 56, to thus reach a rear end of the case 50 to then be discharged upwardly.

The governor valve 93 may be provided behind the accommodating portion 56. Air that flows rearward due to the third fan 85 may also cool the governor valve 93 and may then be discharged to the outside of the case. In other words, the air flow generated by the third fan does not need to be guided by using a duct-like structure, and thus, the governor valve 93 at the rear end of the case 50 may be located directly below the vent 30. Therefore, it may be difficult to cover the governor valve 93 with a duct structure.

The top plate 2 may include a top plate frame 10 forming an outer frame of the overall top plate, the top plate 20 fastened to an inside of the top plate frame 10, and the vent 30 provided between a rear end of the top plate 20 and a rear surface of the top plate frame 10. The top plate 2 may include a connection bracket 40, which may be fixed to a bottom surface of the top plate 20, to fix the vent 30 to a rear end of the top plate frame 10.

The top plate frame 10 may include an upper portion 11 and side portions 12, which may be bent. The upper portion 11 may have a rectangular shape. The side portions 12 may be bent downwardly at an outer end portion of the upper portion 11.

The top plate 20 and the vent 30 may be fitted and fixed in the top plate frame 10. The top plate 20 may be installed at a front of the top plate frame 10 and the vent 30 may be provided behind the top plate frame 10.

The top plate 20 may be formed of a ceramic glass and have a rectangular flat plate shape having a thickness. A front portion of the top plate 20 may be provided with a manipulation unit display so as to identify a manipulation portion of the manipulation unit accommodated in the accommodating portion 55 of the case described above. The manipulation unit display may be printed on a top surface of the top plate 20, attached in the form of a film, or a corresponding ceramic glass portion may be configured in a transparent or semi-transparent form so that the manipulation unit may be exposed. Also, although the display is not displayed outside before manipulation, when a user touches a vicinity of the manipulation unit, a backlight may be turned on from a bottom of the ceramic glass to display the manipulation unit. A bottom surface of a display portion of the manipulation unit of the top plate 20 may be brought into close contact with a top surface of the manipulation unit.

The manipulation unit and the top plate 20 in close contact with the manipulation unit may be cooled by the air flow of the above-described first fan 96. Thus, a user may not feel so hot, when a user touches a manipulation region of the top plate 20.

In addition, when the top plate 20 has been fixed on the case 50, markers may be provided to display where the heating units are located at corresponding positions of the top plate 20 corresponding to the burners 901 and 902 and the working coil 82. In addition, these markers may distinguish whether the heating units are for the burners, or the induction heating units.

A front edge and both lateral edges of the upper surface of the aforementioned top plate 20 may be in contact with a bottom surface of the upper portion 11 of the top plate frame 10, and the first and second sides and a front side of the top plate 20 may be fixed to an inner surface of the left and right side portions and the front side 12 of the top plate frame 10. According to methods of fixing, for example, a heat resistant silicon adhesive member may be injected between the top plate 20 and the top plate frame 10 and the top plate 20 and the top plate frame 10 may be fit together. The vent 30 having a rectangular shape long in the lateral direction thereof may be installed at a rear side of an inner portion of the top plate frame 10.

Figure 4:
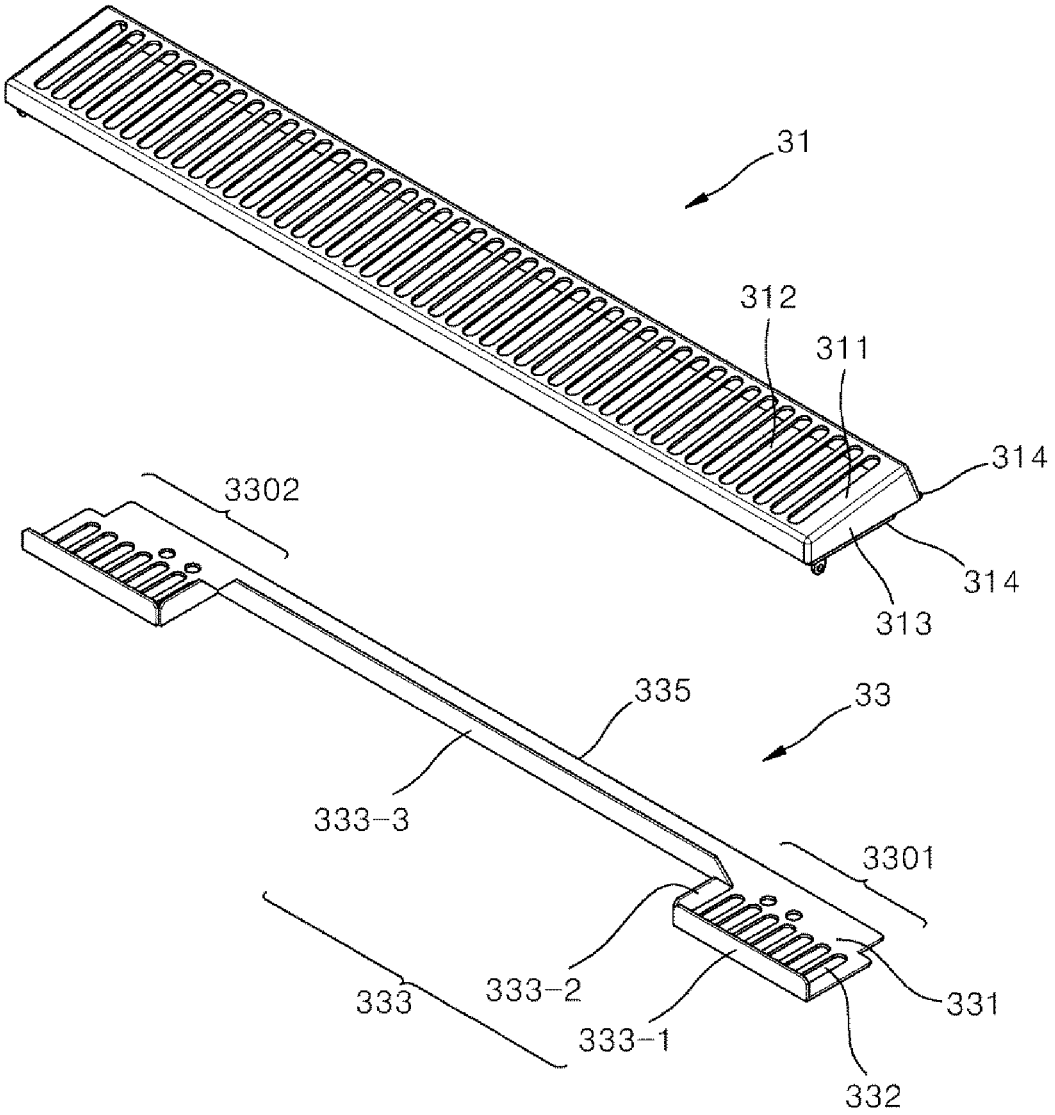
FIG. 4 is an enlarged view of a vent provided in the top plate of FIG. 3.

Referring to FIG. 4, the vent 30 may include a main vent member or main vent 31 forming a top and sides of the vent 30, and a sub-vent member or sub-vent 33 forming a lower portion of the main vent 31. The main vent 31 may include a portion which is exposed above the top plate 2. The portion of the main vent 31 exposed above the top plate 2 may be an entire main exhaust surface portion or main exhaust surface 311 in which a plurality of main exhaust holes 312 may be formed, such as by being perforated, and an upper portion of a main bent portion or side panel 313 which may be bent downwardly from an outer edge of the main exhaust surface 311.

The plurality of main exhaust holes 312 may be a track type long-hole shape extending in a longitudinal direction, and the plurality of main exhaust holes 312 may be formed on the main exhaust surface 311 such that the plurality of main exhaust holes 312 are disposed side-by-side along the lateral direction, or the longitudinal direction of the main exhaust surface 311. The plurality of main exhaust holes 312 may be formed by a piercing process. In this case, a piercing die may be downwardly pressed into the upper portion of the main exhaust surface 311, to thus mold the plurality of main exhaust holes 312, and thus, burrs formed on an inner peripheral surface of the plurality of main exhaust holes 312 may be made to extend in a downward direction, to thereby improve an appearance quality and prevent sharp burrs from being exposed to the outside.

The sub-vent 33 may include a sub-exhaust surface portion or sub-exhaust surface 331 which defines a lower end surface of the vent 30 as a portion that supports a lower surface of the main vent 31 and is provided at a lower portion of the main vent 31. The sub-exhaust surface portion 331 may include a plurality of sub-exhaust holes 332.

The plurality of sub-exhaust holes 332 may have a track type long-hole shape extending in a longitudinal direction, and a plurality of the sub-exhaust holes 332 may be formed on the sub-exhaust surface 331 in a manner such that the plurality of the sub-exhaust holes 332 are arranged side-by-side along the lateral direction, or the longitudinal direction of the sub-exhaust surface 331. The plurality of sub-exhaust holes 332 may be formed by a piercing process. In this case, a piercing die may be upwardly pressed in the lower portion of the sub-exhaust surface 331, to thus mold the sub-exhaust holes 332, and thus, burrs formed on an inner peripheral surface of the plurality of sub-exhaust holes 332 may be made to extend in an upward direction, to thereby prevent sharp burrs from being exposed to the outside.

A sub-bent portion or sub-vent tab 333 may be bent and formed at the outer edge of the sub-exhaust surface 331, and the sub-bent tab 333 of the sub-vent 33 may not be exposed to the outside, and may be arranged in an inner space defined by the main exhaust surface 311 and the side panel 313 of the main vent 31. Therefore, unlike the side panel 313, the sub-bent tab 333 need not be provided on all outer edges of the sub-exhaust surface 331.

Figure 7:
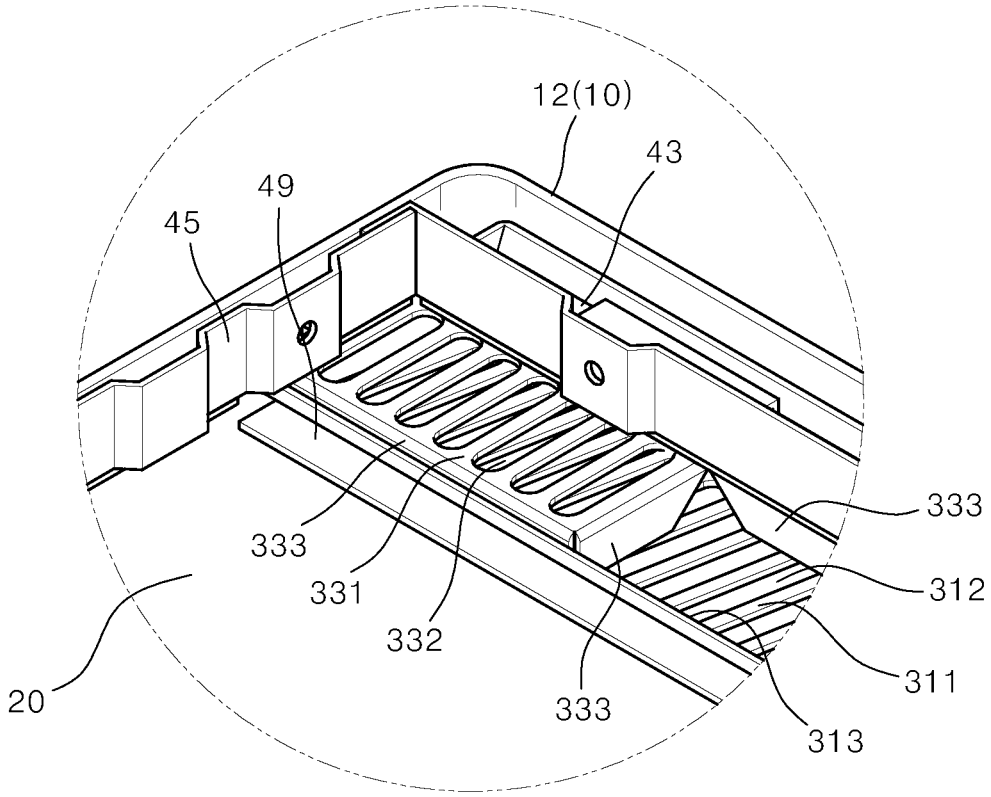
FIG. 7 is an enlarged view of a portion "A" in FIG. 5.

The sub-bent tab 333 may be provided in a minimum degree to define a position of the sub-vent 33 with respect to the main vent 31, when tightening the sub-vent 33 to the main vent 31. Further, the sub-bent tab 333 may ensure a degree of more rigidity than when the sub-vent 33 includes only the flat plate-shaped sub-exhaust surface 331, to thereby be provided with a degree of only minimal rigidity. In view of these points, a sub-bent portion or tab 333-1 in a shape extending along a lateral direction in front of the sub-exhaust surface 331 is provided and, as shown in FIG. 7, side portions of a front end of the sub-bent tab 333-1 may contact with an inner surface of the side panel 313 of the main vent 31 and a bottom surface of the main exhaust surface 311 of the main vent 31, to thereby regulate an installation location of the sub-vent 33. In addition, when the sub-bent tab 331-1 contacts the inside of the main vent 31, even though the sub-bent tab 331-1 is formed on the sub-vent 33, the sub-bent tab 331-1 may not be seen from the outside of the main vent 31. Accordingly, a quality is not emotionally deteriorated.

Installation position regulation of the sub-vent 33 for the main vent 31, which is obtained by making a close contact with the sub-bent tab 333 to the inside of the main vent 33, may be applied to all positions in the forward and backward direction, the lateral direction, and the up and down direction. Among them, the up and down direction position regulation appears as a result that the main exhaust surface 311 and the sub-exhaust surface 331 may be spaced apart from each other by a height of the sub-bent tab 333, which enables smooth exhaust flow through all of the sub-exhaust holes 332 and the main exhaust holes 312.

When the main vent 31 and the sub-vent 33 are secured, the main exhaust holes 312 and the sub-exhaust holes 332 may be arranged so as to be deviated from each other, or cross each other. In a case that both the exhaust holes 312 and 332 are arranged to cross each other, when looking down from the top, internal components housed in an interior space of the case 50 are not viewable from the outside to thus improve an asthetic appearance.

In order to prevent internal components from being visible from outside, the main exhaust holes 312 and the sub-exhaust holes 332 may not only deviate from each other, but may have different shapes or areas. Further, different arrangement directions of the exhaust holes 312 and 332 may be considered. For example, the main exhaust holes 312 and the sub-exhaust holes 332 may be designed by predicting an orientation of a user looking at the vent, in consideration of a structure of a space where a cooker is expected to be installed and an installation location and orientation for the installation of the cooker.

Thus, in a case that at least one of locations, shapes, and areas of the main exhaust holes 312 and the sub-exhaust holes 332 mismatches with one another, when the main exhaust surface 311 and the sub-exhaust surface 331 are arranged too closely, the exhaust flow may cause a huge resistance. In this embodiment, a separation distance of the two exhaust surfaces 311 and 331 may be sufficiently secured by the sub-bent tab as described above, to thus enable a smooth exhaust flow.

In addition, a sub-bent tab 333-2 of a type extending along the frontward-rearward direction in the sub-exhaust surface 331 may further reinforce the rigidity of the sub-exhaust surface 331. As the sub-exhaust surface portion 331 is formed of a rectangular plate shape in which lengths of the frontward-rearward direction and the lateral direction are secured to some extent, a bending stiffness in two directions through the sub-bent tabs 333-1 and 333-2 may be sufficiently secured.

As the sub-bent tab 333-2 also functions as an upwardly extending end portion of the above-described exhaust duct 91, the sub-bent tab 333-2 may also guide the hot exhaust gases to be discharged through the exhaust duct 91 upward while the hot exhaust gases are prevented from backflowing to a space toward an area of the induction heating unit 8, which corresponds to a first vent portion or vent 3301, which will be described hereinafter or a space toward the valve assembly 92, which corresponds to a second vent portion or vent 3302, which will be described hereinafter. The sub-bent tab may distinguish exhaust passages of a first cooking heating unit and a second cooking heating unit having different heating methods from each other.

The sub-vent 33 may be separated or divided into a first vent portion or first sub-vent 3301 and a second vent portion or second sub-vent 3302, and may further include a connecting portion 335 that connects the first sub-vent 3301 and the second sub-vent 3302 to each other, as shown in FIG. 4. In addition, the first sub-vent 3301 and the second sub-vent 3302 may each include a sub-bent portion or tab 333-1 that extends in the lateral direction, and a sub-bent portion or tab 333-2 that extends in the frontward-rearward direction. In addition, the connection portion 335 may include a sub-bent portion or tab 333-3 of the type extending along the longitudinal direction, in other words, in the lateral direction based on the cooker. The sub-bent tab 333-3 may reinforce the rigidity of the elongated connecting portion 335.

The sub-vent 33 may be provided in a region other than a region corresponding to the end of the exhaust duct 91 of the gas combustion heating unit 9, when viewed from a region of the lateral lengthwise direction of the main vent 33. In the region of the main vent 33 corresponding to the end of the exhaust duct 91, even when looking into a space inside of the case 50 through the main exhaust holes 312 from the outside, only the end of the exhaust duct 91 may be visible.

In other words, electrical components or other components within the case 50 may not be seen from the end of the exhaust duct 91 when looking from the outside, to thus improve an aesthetic appearance. Also, because the exhaust duct 91 is the region through which the hottest gas and air is discharged among the rear end regions of the case 50 corresponding to the region in which the vent 30 is installed, the sub-exhaust surface 331 may not be arranged in the corresponding region in order to make the exhaust flow more smoothly.

In contrast, in the region of the main vent 31 other than the region corresponding to the end portion of the exhaust duct 91, when looking into the inner space of the case 50 through the main exhaust holes 312 from outside, the electrical components or other components within the case 50 may be visible, to thereby degrade the aesthetic quality of appearance. Therefore, according to embodiments, it is necessary to improve the appearance quality by arranging the sub-exhaust surface 331 of the sub-vent 33 in this region. When the region in which the exhaust duct 91 is not present is divided into two or more regions, by the region where the exhaust duct 91 exists, in the region of the main vent 31, the sub-vent 33 may be divided into the first sub-vent 3301 and the second sub-vent 3302, for example, as shown in FIG. 4.

Referring back to FIG. 4, the sub-bent tab 333-2 of each of the first sub-vent 3301 and the second sub-vent 3302 may function as a partition wall that separates the regions where the exhaust duct 91 is present and not present in the vent 30. In addition, the sub-bent tab 333-2 may be made into a form of extending the end sides of the exhaust duct upwardly. Lateral end portions of the exhaust duct 91, shown in FIG. 2, and the sub-bent tab 333-2 of FIG. 4 may be aligned with each other in the vertical direction. In other words, the lateral end portions of the exhaust duct 91 may be aligned when positioned at the bottom, and the sub-bent tab 333-2 may be aligned when positioned at the top, and thus, they may be aligned in the upward and downward direction.

Thus, the exhaust flow in the exhaust duct through which the hottest exhaust gas are discharged, may be guided upward while flowing along the sub-bent tab 333-2 and may be discharged to the outside of the cooker 1. The exhaust gas may not flow back and may not be re-introduced into the other space of the case 50, the space where the valve assembly 92 is located or the space where the induction heating unit 8 is located.

The sub-bent tab 333-3 of the connecting portion 335 may be formed by extending the rear end of the exhaust duct 91 upwardly. A rear-side end of the exhaust duct 91 shown in FIG. 2 and the sub-bent tab 333-3 of FIG. 4 may be aligned with each other in the vertical direction. In other words, the rear end of the exhaust duct 91 may be aligned at the bottom, and the sub-bent tab 333-3 may be aligned at the top, as they are aligned in the upward and downward direction. In addition, the upper end of the sub-bent tab 333-3 may be in contact with the bottom surface of the main exhaust surface 311, and may be aligned with the rear end portion of the main exhaust holes 312.

Thus, the exhaust flow in the exhaust duct through which the hottest exhaust gas are discharged may be guided upward while flowing along the sub-bent tab 333-3 and may be discharged to the outside of the cooker. The exhaust gas may not flow back and may not be re-introduced into the case 50.

The side panel 313, which is located in front of the main vent 31, may also be aligned with the front end portion of the discharge port 910 of the exhaust duct 91. The discharge port 910 of the exhaust duct 90 may have an upward extending shape, together with the main bent tab 313 and the sub-bent tabs 333-2 and 333-3.

An outward flange 314 may extend in an outward direction from a bottom or side of the side panel 313 of the main vent 31. The vent 30 may be inserted upward into the top plate frame 10 from a lower space thereof and may be fixed to the top plate frame 10. The outward flange 314 may interfere with the bottom surface of the upper surface portion 11 of the top plate frame 10 in the process of inserting the vent 30 upwardly to the top plate frame 10, to thereby regulate an insertion height of the vent 30.

Figure 5:
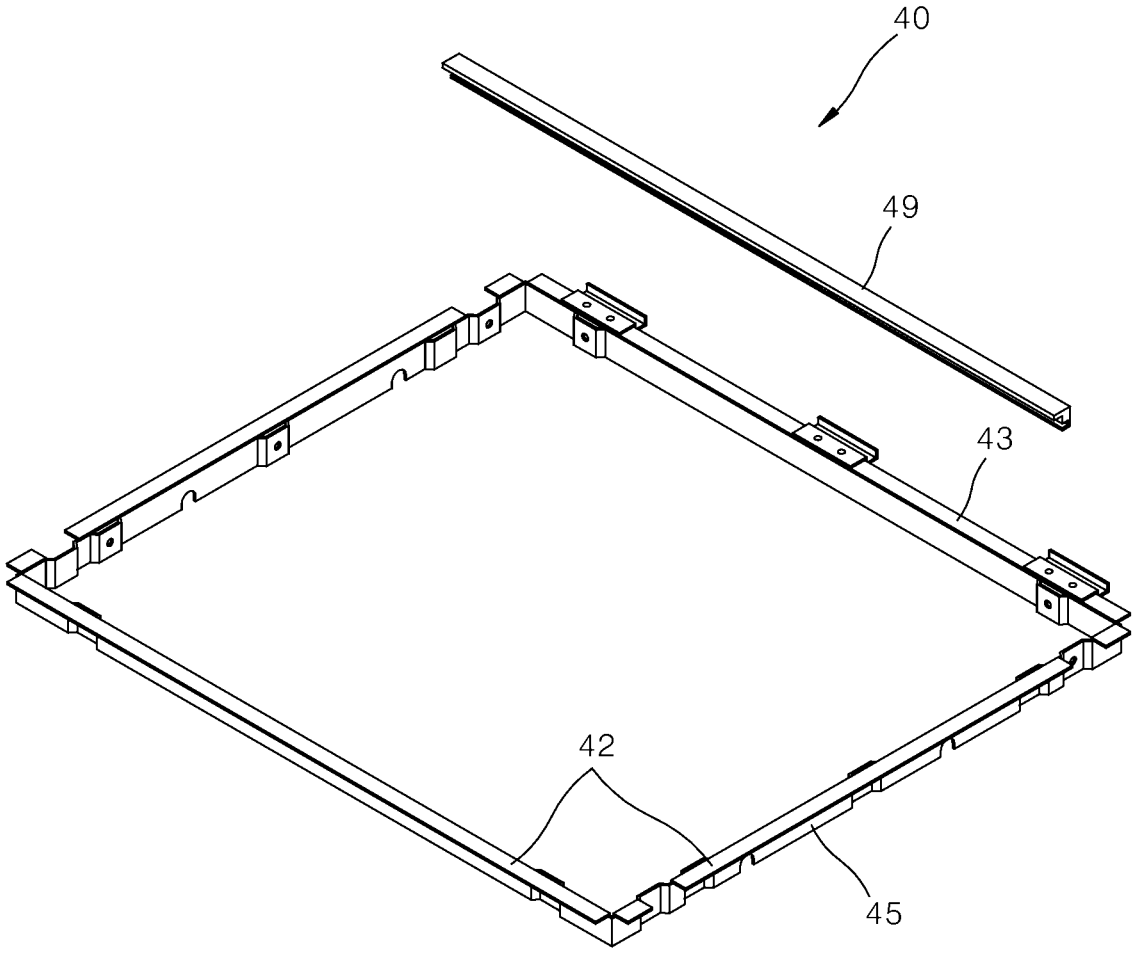
FIG. 5 is a perspective view of a fastening frame installed at a lower end of a top plate frame of the top plate of FIG. 3.
Figure 6:
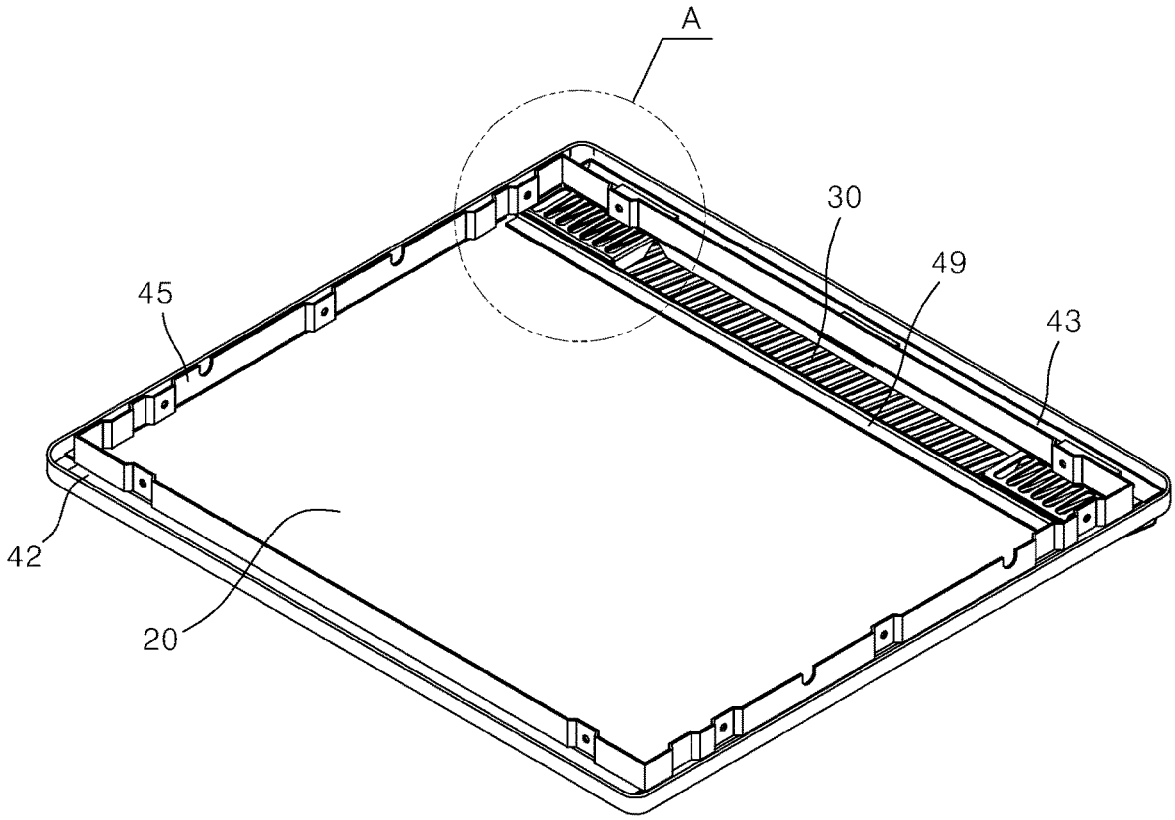
FIG. 6 is a bottom perspective view of the top plate of FIG. 1.

The top plate 2 may have an overall fixed structure by the top plate frame 10 and the connecting bracket 40. Referring to FIG. 5, the connecting bracket 40 may have a rectangular shape having a smaller size than the top plate frame 10. This is because the top plate 2 may have a slightly larger area than the main body 3 in this embodiment.

An upper surface of a front portion and both side portions of the connecting bracket 40 may be a top plate fixing section or top plate fixing tab 42, which may be fixed to the bottom surface of the top plate 20. In addition, an upper surface of a rear portion of the connecting bracket 40 may be a vent member fixing portion or vent fixing tab 43 that fixes the vent 30. A case fixing portion 45 may be downwardly bent and have a downwardly extending shape on inner peripheral surfaces of the fixing portions 42 and 43.

The top plate 20 may be fitted in front of the inner space of the top plate frame 10, and an adhesive member, such as heat-resistant silicone, may be interposed therebetween to thus mutually fix the top plate frame 10 and the top plate 20. In addition, the vent 30 may be fitted in the rear side of the top plate 20 of the inner space of the top plate frame 10. In addition, the outward flanges 314 may interfere with the top plate frame 10 and the main vent 31 may protrude to the upper portion of the top plate frame 10. Further, a sealing portion or sealing bracket 49 may be additionally interposed between the vent 30 and the top plate 20.

Next, the vent fixing tab 43 of the connecting bracket 40 may be fixed on the rear portion of the top plate frame 10 by rivets, for example, and the upper surface of the vent fixing portion 43 may support the bottom surface of the vent 30. In addition, the top plate fixing portion 42 of the connecting bracket 40 may be fixed and bonded on a lower surface of the top plate 20 using the heat-resistant silicone, for example.

For example, when the top plate 2 has been assembled, and the barrier 7, the induction heating unit 8, and the gas combustion heating unit 9 have been installed in the case 50, the case fixing portion 45 of the top plate 20 may be fitted on the inner sides of the side portions 52, the front portion 53, and the rear portion 54 of the case 50, and then the case 50 and the case fixing portion 45 may be fixed using fasteners, such as bolts, or screws, for example, to thereby complete assembly of the cooker 1.

When the assembly is completed as described above, the sub-exhaust surface 331 of the sub-vent 33 forming a lower portion of the vent 30 may be supported with a structure or support, such as the barrier 7 provided inside of the case 50. Accordingly, it may be possible to regulate a position of the vent in the case from a geometric positional relationship between the structure and the sub-vent. In addition, as the sub-vent performs a function of receiving a supporting force provided by the structure for the vent, the vent member may function as structure of the cooker, and thus, it is possible to create a more robust cooker.

According to embodiments disclosed herein, a vent member or vent may be installed or provided at a rear side of an upper surface of a cooker. The vent member may include a main vent member or vent exposed through an upper portion of the cooker and including a main exhaust surface portion or surface in which main exhaust holes may be perforated or formed, and a sub-vent member or sub-vent spaced apart from a lower portion of the main vent member, aligned in parallel with the main exhaust surface portion and including a sub-exhaust surface portion or surface in which sub-exhaust holes may be perforated or formed.

The vent member may include the main exhaust surface portion and the sub-exhaust surface portion having the exhaust holes, but are arranged to be spaced apart from each other, so that components accommodated in an inside of the cooker are not only visible from the outside by utilizing the sub-exhaust surface portion, but also the main exhaust surface portion and the sub-exhaust surface portion are arranged to be spaced apart from each other so that an exhaust flow may be smoothly performed.

At least one of perforation positions, shapes, and areas of the main exhaust holes and the sub-exhaust holes may be inconsistent with one another when viewed from above. Accordingly, arrangements, shapes, and areas of the exhaust holes may be utilized to prevent an internal structure from being visible from the outside.

The main vent member may include a main bent portion bent downwardly at an outer edge of the main exhaust surface portion. The sub-vent member may include a sub-bent portion bent upwardly from an edge of the sub-exhaust surface portion. At least a part or portion of the sub-bent portion may be positioned in contact with an inside of the main bent portion.

Accordingly, the main vent member may include the main bent portion to induce an exhaust flow, and when the main vent member and the sub-vent member are assembled so that the main bent portion is in contact with the sub-bent portion, mutual positions (up and down direction and/or front and rear and lateral directions) between the main vent member and the sub-vent member may be realized. Further, as the sub-bent portion is in contact with an inside of the main bent portion, the sub-bent portion may not be visible from the outside, and the appearance may still be beautiful.

The sub-vent member may include a first vent portion or vent and a second vent portion or vent spaced apart from each other. The first vent portion and the second vent portion may be connected to each other through a connecting portion. Accordingly, when it is necessary to divide the vent portions from each other due to the fact that two or more portions where the sub-vent members are required are spaced apart from each other, the divided sub-vent members may be integrally connected through the connecting portion, and thus, it is not necessary to separately position the sub-vent members, so that an assembly may be performed easily.

The connecting portion may include a sub-bent portion bent upwardly from an edge along a longitudinal direction thereof. When the connecting portion includes the sub-bent portion as described above, the connecting portion may prevent an air flow from being interrupted, and the connecting portion may guide an exhaust flow at a position where the sub-vent member is not provided. In addition, a section of the connecting portion may be heightened to thus enhance a rigidness of the connecting portion, and thereby simplify a manufacturing process.

An edge of the sub-bent portion may be aligned with and positioned at an edge of each of the main exhaust holes of the main vent member. Accordingly, a height between the main vent member and the sub-vent member may be defined when the sub-bent portion of the connecting portion contacts the main vent member, and the exhaust flow may be guided to the main exhaust holes. The main exhaust holes may be downwardly pierced to form burs downwardly, and the sub-exhaust holes may be upwardly pierced to form burs upwardly. Thus the burs may be positioned inside and sharp surfaces may not be exposed to the outside.

Embodiments disclosed herein provide a cooker that may include a top plate frame to which a top plate may be fixed; a vent member or vent fixed to an inside of a rear end of the top plate frame; and a case fixed to lower portions of the vent member and the top plate frame and having a gas combustion heating unit or heater therein. The vent member may include a main vent member or vent exposed through an upper portion of the cooker and including a main exhaust surface portion or surface in which main exhaust holes may be perforated or formed and at least a portion of which communicates with an end of an exhaust duct of the gas combustion heating unit; and a sub-vent member or sub-vent spaced apart from a lower portion of the main vent member in a region other than part of the main vent member communicating with the exhaust duct, aligned in parallel with the main exhaust surface portion and including a sub-exhaust surface portion or surface in which sub-exhaust holes may be perforated or formed. As described above, by configuring the sub-vent member only in a range in which internal components of the cooker are visible, it is possible to prevent the sub-vent member from being installed in a region where the sub-vent member is not needed, to thereby prevent a phenomenon of raising a resistance to the exhaust flow.

The cooker may further include an induction heating unit or heater, and a region where the sub-vent member is installed or provided may include a rear end region of the induction heating unit where air cooling the induction heating unit may be discharged. The induction heating unit may include a working coil and a high heat emitting chip, such as an IGBT (Insulated Gate Bipolar Transistor (IGBT)). An air flow for cooling the induction heating unit may be moved and discharged to a rear of the induction heating unit. A PCB (Printed Circuit Board) for operating and controlling the working coil may be covered with a separate duct cover. The PCB may be shielded from being seen. Otherwise, by providing the sub-vent member instead of shielding the PCB with the separate duct cover, the internal structure may be prevented from being visible from the outside even with a simple structure.

The cooker may include a valve assembly that controls a supply of gas supplied to the gas combustion heating unit, and a region where the sub-vent member is installed or provided may include a rear end region of the valve assembly, through which air cooling the valve assembly may be discharged. Accordingly, it may be possible to prevent internal structure from being visible from the outside even with a simple structure. More particularly, when at least one of perforation positions, shapes, and areas of the main exhaust hole and the sub-exhaust hole are inconsistent with one another when viewed from above, in such an installation structure, an effect influenced upon the exhaust flow may be minimized and a visual shield of an internal structure may be achieved with a simple structure.

A lower surface of the sub-exhaust surface portion may be supported by a structure or a support provided inside of the case. Accordingly the case, the structure (support), the sub-vent member, the main vent member, and the top plate frame may be structurally mutually supported, so that the cooker may be manufactured more firmly.

The sub-vent member may include a sub-bent portion bent upwardly from an edge of the sub-exhaust surface portion, and a portion of the sub-bent portion may be a structure provided at an end of the exhaust duct in a form that the end of the exhaust duct extends. The sub-bent portion may reinforce a rigidity of the sub-vent member and function as a portion of the end portion of the exhaust duct of the gas combustion heating unit to thus guide the exhaust flow of the high-temperature combustion gas upwardly to thereby prevent the high-temperature combustion gas from flowing back into an inner space inside of the case other than the gas combustion heating unit.

The sub-vent member may include a first vent portion or vent and a second vent portion or vent spaced apart from each other, and the first vent portion and the second vent portion may be connected to each other through a connecting portion. The connecting portion may have a sub-bent portion bent upwardly from an edge along the longitudinal direction. The sub-bent portion constituting the connecting portion may be a structure disposed at an end of the exhaust duct in a form that the end of the exhaust duct extends. Accordingly, the sub-bent portion forming the connecting portion may not only reinforce a rigidity of the connecting portion but also function as a part of the end portion of the exhaust duct of the gas combustion heating unit, to thereby guide the exhaust flow of high-temperature combustion gas upwardly.

The first vent portion and the second vent portion may each have a sub-bent portion bent upwardly from the edge of the sub-exhaust surface portion, and the sub-bent portions of the first vent portion and the second vent portion may be provided at an end of the exhaust duct in a form that the end of the exhaust duct extends. Accordingly, the sub-bent portion may not only reinforce a rigidity of the sub-vent members of the first vent portion and the second vent portion but also function as a portion of the end portion of the exhaust duct of the gas combustion heating portion, to thereby prevent high-temperature combustion gas from flowing back into an inner space inside of the case through the first vent portion and the second vent portion.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooker including a vent configured to be installed at a rear side of an upper surface of the cooker, the vent comprising:

a main vent configured to be exposed through the upper surface of the cooker and including a main exhaust surface having a plurality of main exhaust holes; and a sub-vent spaced apart from a lower portion of the main vent and including a sub-exhaust surface having a plurality of sub-exhaust holes, wherein the cooker comprises:

a first heater housed in the cooker, the first heater being a gas combustion heater having an exhaust duct which extends to a rear portion of the cooker; and a second heater housed in the cooker adjacent to the first heater, wherein the second heater is not a gas combustion heater, wherein a discharge port is provided at an end of the exhaust duct, and an exhaust gas burned in the first heater is discharged upwardly through the discharge port, wherein the main vent is divided into a first portion and a second portion, wherein the first portion of the main vent is a portion at an upper surface of the discharge port, wherein the second portion of the main vent is a portion other than the first portion of the main vent, wherein the sub-exhaust surface is positioned at a lower surface of the second portion of the main vent, wherein the discharge port communicates with the first portion of the main vent without communicating with the sub-vent such that the sub-exhaust surface does not face a flow of the exhaust gas discharged through the discharge port to the first portion of the main vent, wherein the sub-vent includes a first sub-vent tab bent up from a first edge of the sub-exhaust surface, wherein a portion of the first sub-vent tab is provided at and extends along an end of the exhaust duct so that the flow of the exhaust gas discharged through the discharge port is guided up along the first sub-vent tab, wherein the sub-vent includes a first sub-vent, and a second sub-vent spaced apart from each other, wherein the first sub-vent and the second sub-vent are connected to each other through a connecting piece, wherein the sub-vent further includes second sub-vent tabs, wherein each of the second sub-vent tabs is provided at each of the first sub-vent and the second sub-vent, and wherein the second sub-vent tabs are provided at and extend along the end of the exhaust duct.

2. The cooker according to claim 1, wherein at least one of positions, shapes, or areas of the plurality of main exhaust holes is different from the plurality of sub-exhaust holes when viewed from above.

3. The cooker according to claim 1, wherein the main vent includes a side panel bent downwardly at an outer edge of the main exhaust surface, and wherein at least a portion of the first sub-vent tab and the second sub-vent tabs contacts an inside of the side panel.

4. The cooker according to claim 1, wherein the sub-vent includes a first sub-vent and a second sub-vent spaced apart from each other, and the first sub-vent and the second sub-vent are connected to each other through a connecting piece.

5. The cooker according to claim 4, wherein the first sub-vent tab is bent upwardly from an edge of the connecting piece along a longitudinal direction.

6. The cooker according to claim 5, wherein an edge of the first sub-vent tab is aligned with and positioned at an edge of at least some of the plurality of main exhaust holes of the main vent.

7. The cooker according to claim 1, wherein the plurality of main exhaust holes is downwardly pierced to form burs in a downward direction, and the plurality of sub-exhaust holes is upwardly pierced to form burs in an upward direction.

8. A cooker, comprising:

a top plate frame to which a top plate is fixed;

a vent fixed to an inside of a rear end of the top plate frame; and a case fixed underneath the vent and the top plate frame and having a first cooking heater and a second cooking heater therein, wherein the first cooking heater is a gas combustion heater having an exhaust duct which extends to a rear portion of the case and the second heater is not a gas combustion heater, wherein the vent includes:

a main vent exposed through an upper surface of the cooker and including a main exhaust surface having a plurality of main exhaust holes; and a sub-vent spaced apart from the main vent and aligned with the main exhaust surface, and including a sub-exhaust surface including a plurality of sub-exhaust holes, wherein an exhaust gas burned in the first cooking heater is discharged upwardly through a rear end of the exhaust duct, wherein the main vent is divided to a first portion and a second portion, wherein the first portion of the main vent is a portion at an upper surface of the rear end of the exhaust duct, wherein the second portion of the main vent is a portion other than the first portion of the main vent, wherein the sub-exhaust surface is positioned at a lower surface of the second portion of the main vent, wherein the rear end of the exhaust duct communicates with the first portion of the main vent without communicating with the sub-vent such that the sub-exhaust surface does not face a flow of the exhaust gas discharged from the rear end of the exhaust duct to the first portion of the main vent, wherein the sub-vent includes a first sub-vent tab bent up from a first edge of the sub-exhaust surface, wherein a portion of the first sub-vent tab is provided at and extends along an end of the exhaust duct so that the flow of the exhaust gas discharged through the rear end of the exhaust duct is guided up along the first sub-vent tab, wherein the sub-vent includes a first sub-vent, and a second sub-vent spaced apart from each other, wherein the first sub-vent and the second sub-vent are connected to each other through a connecting piece, wherein the sub-vent further includes second sub-vent tabs, wherein each of the second sub-vent tabs is provided at each of the first sub-vent and the second sub-vent, and wherein the second sub-vent tabs are provided at and extend along the end of the exhaust duct.

9. The cooker according to claim 8, further including a distribution valve that controls a supply of gas to the gas combustion heater, wherein a region in which the sub-vent is installed includes a rear end of the distribution valve through which air that cools the distribution valve is discharged.

10. The cooker according to claim 8, wherein a region in which the sub-vent is installed includes a rear end of the second cooking heater through which air that cools the second cooking heater is discharged.

11. The cooker according to claim 10, wherein the second cooking heater is an induction heater.

12. The cooker according to claim 8, wherein at least one of perforation positions, shapes, and areas of the plurality of main exhaust holes is different from the plurality of sub-exhaust holes when viewed from above.

* * * * *